US010933262B2

(12) United States Patent
Wagner et al.

(10) Patent No.: US 10,933,262 B2
(45) Date of Patent: Mar. 2, 2021

(54) OXYGEN-REDUCING INSTALLATION AND METHOD FOR OPERATING AN OXYGEN-REDUCING INSTALLATION

(71) Applicant: WAGNER Fire Safety, Inc., Boston, MA (US)

(72) Inventors: Ernst-Werner Wagner, Winsen (DE); Julian Eichhoff, Hannover (DE)

(73) Assignee: WAGNER FIRE SAFETY, INC., Boston, MA (US)

( * ) Notice: Subject to any disclaimer, the term of this patent is extended or adjusted under 35 U.S.C. 154(b) by 0 days.

(21) Appl. No.: 14/977,755

(22) Filed: Dec. 22, 2015

(65) Prior Publication Data

US 2017/0173373 A1 Jun. 22, 2017

(51) Int. Cl.

| | |
|---|---|
| ***A62C 2/04*** | (2006.01) |
| ***A62C 37/08*** | (2006.01) |
| ***A62C 35/64*** | (2006.01) |
| ***A62C 35/68*** | (2006.01) |
| ***A62C 99/00*** | (2010.01) |

(52) U.S. Cl.

CPC ..... *A62C 2/04* (2013.01); *A62C 35/645* (2013.01); *A62C 35/68* (2013.01); *A62C 37/08* (2013.01); *A62C 99/0018* (2013.01); *A62C 99/0063* (2013.01)

(58) Field of Classification Search

CPC ..... A62C 2/04; A62C 35/645; A62C 37/08; A62C 99/0018; A62C 99/0027; A62C 3/00; A62C 3/06; A62C 35/00; A62C 37/10; A62C 99/00; A62C 37/44

USPC ..... 169/45; 141/39, 94, 95, 4, 51

See application file for complete search history.

(56) References Cited

U.S. PATENT DOCUMENTS

| | | | | |
|---|---|---|---|---|
| 4,378,920 | A | 4/1983 | Runnels et al. | |
| 6,257,000 | B1 * | 7/2001 | Wang | F17O 7/00 222/3 |
| 6,390,203 | B1 * | 5/2002 | Borisov | A62C 3/07 169/60 |
| 2004/0079441 | A1 * | 4/2004 | Richey, II | F17C 5/06 141/83 |
| 2007/0151454 | A1 | 7/2007 | Marwitz et al. | |

(Continued)

FOREIGN PATENT DOCUMENTS

| | | | |
|---|---|---|---|
| CN | 1441687 | A | 9/2003 |
| CN | 101547722 | A | 9/2009 |

(Continued)

OTHER PUBLICATIONS

Chinese Office Action issued by the Chinese Patent Office corresponding to Chinese Patent Application No. 2016800753588, dated Oct. 27, 2020.

*Primary Examiner* — Tuongminh N Pham

(74) *Attorney, Agent, or Firm* — Arent Fox LLP

(57) ABSTRACT

An oxygen-reducing installation and method include a compressed gas storage having a container for storing a compressed gas, which can be an oxygen-reduced gas mixture or an inert gas, and having a fluid connection to an enclosed area via a line system to feed at least a portion of the compressed gas to the enclosed area. A gas separation system provides an oxygen-reduced gas mixture and includes an outlet for delivery of the oxygen-reduced gas mixture produced in the gas separation system to the compressed gas storage and/or to the enclosed area as required.

18 Claims, 6 Drawing Sheets

(56) References Cited

U.S. PATENT DOCUMENTS

| | | | | |
|---|---|---|---|---|
| 2007/0186982 | A1* | 8/2007 | Cohen | F17C 5/007 137/487.5 |
| 2008/0156505 | A1* | 7/2008 | Wagner | A62C 99/0018 169/11 |
| 2009/0014187 | A1* | 1/2009 | Wagner | A62C 3/004 169/46 |
| 2010/0065287 | A1* | 3/2010 | Burkhart | A62C 35/58 169/17 |
| 2010/0236796 | A1* | 9/2010 | Chattaway | A62C 37/44 169/46 |
| 2011/0048747 | A1* | 3/2011 | Gastonides | A62C 3/08 169/66 |

FOREIGN PATENT DOCUMENTS

| | | | |
|---|---|---|---|
| CN | 101801467 | A | 8/2010 |
| CN | 102170942 | A | 8/2011 |
| DE | 19811851 | A1 | 9/1999 |
| EP | 1363052 | A1 | 11/2003 |
| EP | 1375349 | B1 | 6/2005 |
| EP | 1671681 | A1 | 6/2006 |
| EP | 1913978 | A1 | 4/2008 |
| EP | 1913980 | A1 | 4/2008 |
| EP | 2233175 | A1 | 9/2010 |

* cited by examiner

OXYGEN-REDUCING INSTALLATION AND METHOD FOR OPERATING AN OXYGEN-REDUCING INSTALLATION

CROSS REFERENCE TO RELATED APPLICATIONS

N/A

STATEMENT REGARDING FEDERALLY SPONSORED RESEARCH OR DEVELOPMENT

N/A

FIELD OF THE INVENTION

The present invention relates to an oxygen-reducing installation and a method for operating such an installation.

BACKGROUND

An oxygen-reducing installation can be used to serve in particular for controlled reduction of the oxygen content in the atmosphere of an enclosed area. For this purpose, the oxygen-reducing installation has an inert gas source for providing an oxygen-reduced gas mixture or an inert gas, and a line system which is connected or can be connected with regard to flow to the inert gas source and to the enclosed area in order to feed at least some of the gas mixture or gas provided by the inert gas source to the enclosed area as required.

The installation serves, for example, to reduce the risk of and to extinguish fires in a protected space which is to be monitored, wherein for fire prevention or for fire fighting the enclosed space also is or can be permanently inerted to various lowered levels.

The fundamental principle of the inerting method for fire prevention is based on the finding that in enclosed spaces entered into only occasionally by humans or animals and containing equipment which reacts sensitively to the action of water the risk of fire can be counteracted by lowering the oxygen concentration in the area in question to a value of, for example, about 15 vol. %. At such a (reduced) oxygen concentration most combustible materials can no longer ignite. The main fields of use of this inerting method for fire prevention are accordingly also EDP regions, electrical switch and distribution rooms, enclosed equipment and storage regions with economic goods of particularly high value.

The fire prevention effect is based on the principle of oxygen displacement. Normal ambient air is known to comprise oxygen to the extent of 21 vol. %, nitrogen to the extent of 78 vol. % and other gases to the extent of 1 vol. %. For fire prevention the oxygen content in the spatial atmosphere of the enclosed space is reduced by introducing an oxygen-displacing gas, such as, for example, nitrogen. It is known that a fire prevention effect starts as soon as the oxygen content falls below normal ambient air content. Depending on the combustible materials present in the protected space, a further lowering of the oxygen content to, for example, 12 vol. % may be necessary.

An oxygen-reducing installation of the abovementioned type is known in principle from the prior art. For example, the publication DE 198 11 851 A1 describes an inerting installation which is configured to lower the oxygen content in an enclosed space to a particular base inerted level and in the event of a fire to further lower the oxygen content rapidly to a particular fully inerted level.

The term "base inerted level" used herein is to be understood as meaning a reduced oxygen content compared with the oxygen content of normal ambient air, where, however, this reduced oxygen content does not yet mean any danger at all to persons or animals, so that these could still enter—at least briefly—the permanently inerted area without problems, i.e. without particular safety precautions, such as, for example, oxygen masks. The base inerted level corresponds, for example, to an oxygen content in the enclosed area of from 15 to 17 vol. %.

In contrast, the term "fully inerted level" is to be understood as an oxygen content which is further reduced compared with the oxygen content of the base inerted level and at which the flammability of most materials is already lowered to the extent that these can no longer ignite. Depending on the fire load in the area in question, the fully inerted level as a rule lies at an oxygen concentration of about 12 to 14 vol. %.

In order to equip an enclosed area with an oxygen-reducing installation, on the one hand a corresponding inert gas source is to be provided in order to be able to provide the oxygen-reduced gas mixture or inert gas to be introduced into the enclosed space. The release capacity of the inert gas source, i.e. the amount of inert gas per unit time which can be provided by the inert gas source, should be configured here according to the properties of the enclosed area, in particular according to the space volume and/or the airtightness of the enclosed area.

If the oxygen-reducing installation is employed as a (preventive) fire safety precaution, it is to be ensured in particular that in the event of a fire a sufficient amount of inert gas can be passed into the spatial atmosphere of the enclosed area within the shortest time, so that an extinguishing action starts as rapidly as possible.

The oxygen-reduced gas mixture or inert gas to be passed into the enclosed area as required could indeed be stored in a battery of high pressure cylinders or similar compressed gas storage, but it has become accepted in practice "to produce on site" at least some of the oxygen-reduced gas mixture to be provided by the inert gas source, in particular because the storage of inert gas in batteries of gas cylinders or similar compressed gas storages requires special construction measures.

In order to be able to "produce" on site at least some of the oxygen-reduced gas mixture or inert gas to be provided by the inert gas source, the inert gas source as a rule has—in addition to a battery of high pressure cylinders or similar compressed gas storage—at least one gas separation system in which at least some of the oxygen contained in an initial gas mixture fed to the gas separation system is separated off, so that an oxygen-reduced gas mixture is provided at an outlet of the gas separation system.

The term "initial gas mixture" used herein is to be understood generally as meaning a gas mixture which, in addition to the constituent oxygen, in particular also comprises nitrogen and optionally also further gases (for example noble gases). A possible initial gas mixture is, for example, normal ambient air, i.e. a gas mixture which comprises oxygen to the extent of 21 vol. % and nitrogen to the extent of 78 vol. % and other gases to the extent of 1 vol. %. Nevertheless, it is also conceivable for some of the spatial air contained in the enclosed area to be used as the initial gas mixture, fresh air preferably also being admixed to this spatial air content.

The gas separation system serves in particular to maintain a reduced oxygen content in the spatial atmosphere of an enclosed space at the corresponding level. The release capacity of the gas separation system, i.e. the amount of oxygen-reduced gas mixture which can be provided per unit time at the outlet of the gas separation system, is accordingly matched in particular to the leakproofness of the space shell of the enclosed area, so that corresponding maintenance flooding can be realised via the gas separation system.

On the other hand it is advantageous from the point of view of the installation not to use or not to use only the gas separation system for the first lowering of the oxygen content in the spatial atmosphere of the enclosed area, since a relatively large amount of inert gas or oxygen-reduced gas per unit time is needed for a first lowering. In order to be able to realise this solely with a gas separation system the gas separation system would have to be correspondingly large in configuration, which as a rule cannot be implemented in view of investment costs.

The conventional oxygen-reducing installations therefore as a rule are provided with, in addition to the gas separation system, a compressed gas storage in which an oxygen-reduced gas mixture or inert gas is stored in compressed form. The gas mixture or inert gas stored in this compressed gas storage serves in particular for the rapid lowering of the oxygen content in the corresponding enclosed area in fire cases. It is also conceivable to use the gas mixture or inert gas stored in the compressed gas storage for the first lowering of the oxygen content in the corresponding enclosed area, i.e. for the initial reduction of the oxygen content to a particular inerted level.

SUMMARY OF THE INVENTION

The invention relates to an oxygen-reducing installation and method for operating an oxygen-reducing installation.

In particular, an oxygen-reducing installation is provided which has a gas separation system for providing an oxygen-reduced gas mixture at an outlet of the gas separation system and a compressed gas storage for storing an oxygen-reduced gas mixture or inert gas in compressed form. The compressed gas storage is connected or can be connected with regard to flow to at least one enclosed area via a line system in order to feed at least some of the gas mixture or inert gas stored in the compressed gas storage to the at least one enclosed area as required. On the other hand, the outlet of the gas separation system is connected or can be connected with regard to flow alternatively to an inlet of the compressed gas storage or to the at least one enclosed space, in order to feed the gas mixture provided at the outlet of the gas separation system to the compressed gas storage and/or the at least one enclosed area as required.

Other aspects of the installation and method include the following:

1. An oxygen-reducing installation comprising:

compressed gas storage for storing an oxygen-reduced gas mixture or an inert gas in compressed form, and a fluid connection from the compressed gas storage to at least one enclosed area comprising a line system to feed at least a portion of the oxygen-reduced gas mixture or the inert gas to the at least one enclosed area; and at least one gas separation system for providing an oxygen-reduced gas mixture, and including an outlet for delivery of the oxygen-reduced gas mixture, the outlet connectable to one or both of an inlet to the compressed gas storage and the at least one enclosed area to feed the oxygen-reduced gas mixture produced in the gas separation system to one or both of the compressed gas storage and the at least one enclosed area.

2. The oxygen-reducing installation of item 1, further comprising a compressor system upstream of the gas separation system for compression of an initial gas mixture to be fed to the gas separation system.

3. The oxygen-reducing installation of any of items 1-2, further comprising a compressor system between the outlet of the gas separation system and the inlet of the compressed gas storage to compress the oxygen-reduced gas mixture provided at the outlet of the gas separation system to be fed to the compressed gas storage.

4. The oxygen-reducing installation of item 3, wherein the compressor system is removable.

5. The oxygen-reducing installation of any of items 1-4, further comprising a valve system comprising:

a first valve arrangement between the outlet of the gas separation system and the inlet of the compress gas storage;

a second valve arrangement between an outlet of the compressed gas storage and the at least one enclosed area; and a third valve arrangement between the outlet of the gas separation system and the at least one enclosed area.

6. The oxygen-reducing installation of any of items 1-5, wherein the inlet of the compressed gas storage and the outlet of the compressed gas storage comprise a common connector piece.

7. The oxygen-reducing installation of item 6, wherein the common connector piece comprises a T piece or a Y piece.

8. The oxygen-reducing installation of any of items 1-7, further comprising a control device operative to actuate the first valve arrangement, the second valve arrangement, and the third valve arrangement of the valve system.

9. The oxygen-reducing installation of item 8, wherein the control device is operative to actuate the valve system to connect the outlet of the gas separation system to the inlet of the compressed gas storage only when no flow connection is open between the outlet of the compressed gas storage and an inlet to the at least one enclosed area.

10. The oxygen-reducing installation of item 8, wherein the control device is operative to actuate the valve system to connect the outlet of the gas separation system to the inlet of the compressed gas storage when a flow connection is open between the outlet of the compressed gas storage and an inlet to the at least one enclosed area.

11. The oxygen-reducing installation of any of items 8-10, wherein the control device is operative to actuate the valve system to connect the outlet of the gas separation system to an inlet to the at least one enclosed area.

12. The oxygen-reducing installation of any of items 8-11, further comprising a sensor unit comprising one or both of a pressure sensor disposed to measure pressure within the compressed gas storage and a temperature sensor disposed to measure temperature within the compressed gas storage, the control device in communication with the pressure sensor, the temperature sensor, or both the pressure sensor and the temperature sensor, and wherein the control device is operative to feed an oxygen-reduced gas mixture from the gas separation system to the compressed gas storage based on sensed pressure measurements, sensed temperature measurements, or both sensed pressure and temperature measurements.

13. The oxygen-reducing installation of any of items 8-12, wherein the gas separation system is operative in a first operational mode to introduce an oxygen-reduced gas mixture from the gas separation system to the compressed gas storage and in a second operational mode to introduce an oxygen-reduced gas mixture from the gas separation system to the at least one enclosed area.

14. The oxygen-reducing installation of any of items 8-13, further comprising a compressor system upstream of the gas separation system for compression of an initial gas mixture to be fed to the gas separation system, wherein the compressor system is in communication with the control device.

15. The oxygen-reducing installation of any of items 8-14, further comprising a compressor system between the outlet of the gas separation system and the inlet of the compressed gas storage to compress the oxygen-reduced gas mixture provided at the outlet of the gas separation system to be fed to the compressed gas storage, wherein the compressor system is in communication with the control device.

16. The oxygen-reducing installation of any of items 1-15, wherein:

the compressed gas storage comprises a plurality of compressed gas containers, each compressed gas container including a container valve, the compressed gas containers connected in parallel between a first collecting line and a second collecting line;

each compressed gas container connectable at the container valve to an associated first line section in fluid communication with the first collecting line and to an associated second line section in fluid communication with the second collecting line;

the outlet of the gas separation system is connectable via a first valve to the first collecting line; and the second collecting line is connectable via an area valve to the at least one enclosed area.

17. The oxygen-reducing installation of item 16, further comprising a control device operative to actuate the first valve, the container valves, and the area valve in a coordinated manner so that the outlet of the gas separation system is connectable for fluid communication with the inlet of at least one compressed gas container when the outlet of the at least one compressed gas container is in fluid communication with the at least one enclosed area.

18. The oxygen-reducing installation of item 17, further comprising a pressure sensor disposed in at least one compressed gas container and in communication with the control device, and the control device is operative to open the first valve to connect the outlet of the gas separation system in fluid communication with the at least one compressed gas container when a sensed pressure reaches or falls below a predetermined minimum pressure.

19. The oxygen-reducing installation of item 18, further comprising a temperature sensor disposed in at least one compressed gas container and in communication with the control device, and the control device is operative to calculate a temperature-compensated pressure value and to open the first valve to connect the outlet of the gas separation system in fluid communication with the at least one compressed gas container when a calculated temperature-compensated pressure value falls below a predetermined minimum pressure.

20. The oxygen-reducing installation of any of items 16-19, wherein the container valve of each of the compressed gas containers comprises a pneumatically actuatable quick release valve arrangement between the compressed gas container and the second collecting line, and the quick release valve arrangement is operable to switch off when the outlet of the gas separation system is connected for fluid communication with the compressed gas container.

21. The oxygen-reducing installation of any of items 16-20, further comprising at least one backflow preventer disposed between the container valve of at least one of the compressed gas containers and the second collecting line to block a gas flow from the second collecting line to the at least one of the compressed gas containers, or between the container valve of at least one of the compressed gas containers and the first collecting line to block a gas flow from the second collecting line to the at least one of the compressed gas container, or between the container valve and both the second collecting line and the first collecting line.

22. The oxygen-reducing installation of item 21, wherein the at least one backflow preventer comprises a non-return valve.

23. The oxygen-reducing installation of any of items 1-22, wherein the at least one enclosed area includes a building or a room enterable by humans.

24. A method for operating an oxygen-reducing installation, comprising;

(a) providing the oxygen-reducing installation of any of items 1-23;

(b) storing an oxygen-reduced gas mixture or an inert gas in compressed form in the compressed gas storage;

(c) for a rapid reduction of an oxygen content in a spatial atmosphere of the at least one enclosed area, feeding at least a portion of the oxygen-reduced gas mixture or the inert gas in the compressed gas storage to the enclosed area;

(d) for maintaining a reduced oxygen content and/or for reducing the oxygen content in the spatial atmosphere of the at least one enclosed area, feeding an oxygen-reduced gas mixture from the gas separation system to the enclosed area; and (e) refilling the compressed gas storage at least partially with an oxygen-reducing gas mixture from the gas separation system.

25. The method of item 24, wherein step (e) takes place after step (c).

26. The method of any of items 24-25, wherein step (e) takes place in parallel with step (d).

27. The method of any of items 24-26, further comprising, prior to step (c), detecting a presence of a fire in the enclosed area.

28. The method of any of items 24-27, further comprising measuring a pressure within the compressed gas storage, and performing step (e) when the pressure decreases to a predetermined minimum level.

29. The method of any of items 24-28, further comprising detecting an oxygen content in the enclosed area, and performing step (d) when the oxygen content increases to a predetermined level.

DESCRIPTION OF THE DRAWINGS

Examples of embodiments of the oxygen-reducing installation according to the invention are described in more detail in the following with the aid of the accompanying drawings. The figures show.

DETAILED DESCRIPTION OF THE INVENTION

Figure 1:
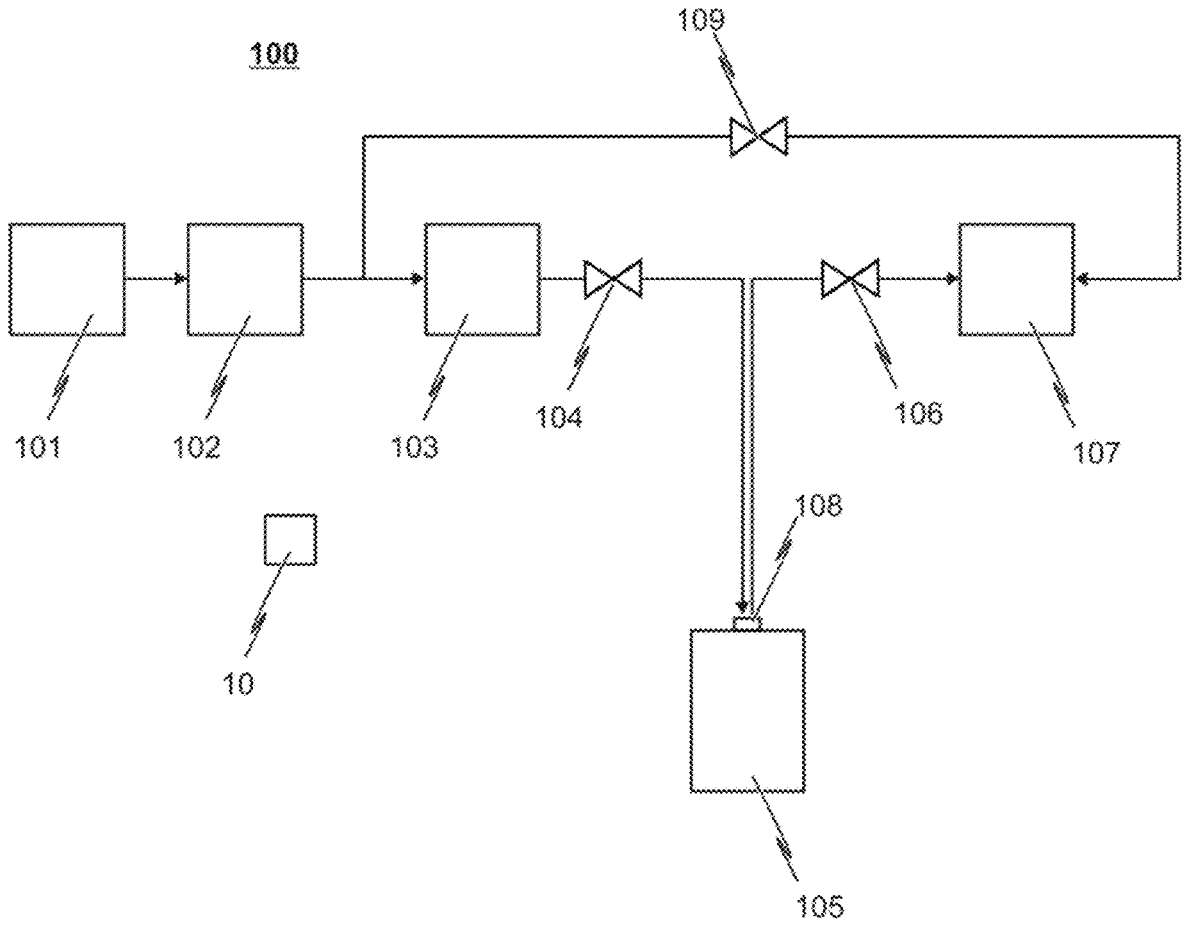
FIG. 1 a diagram of a first example of an embodiment of the oxygen-reducing installation according to the invention.

The present invention is based on the problem that after a conventional oxygen-reducing installation has been triggered, i.e. when the oxygen-reduced gas mixture or inert gas stored in compressed form in the compressed gas storage has been passed into the enclosed space for the rapid or first lowering, replacement of the compressed gas storage which has then been emptied or partially emptied with a full compressed gas storage is unavoidable, in order to ensure that a rapid lowering according to a given course of events can also be realised again with the oxygen-reducing installation at a later point in time.

In many cases, however, replacement or changing of the compressed gas storage can be realised only with increased outlay, since the compressed gas storage of an oxygen-reducing installation often is not arranged freely accessibly. This circumstance also leads inter alia to the running operating costs of an oxygen-reducing installation often being relatively high.

On the basis of this problem, the object of the present invention is to further develop an oxygen-reducing installation of the abovementioned type such that the running operating costs during operation of the oxygen-reducing installation can be reduced further without the effectiveness or efficiency of the oxygen-reducing installation being impaired.

Accordingly, in particular an oxygen-reducing installation is provided which has a gas separation system for providing an oxygen-reduced gas mixture at an outlet of the gas separation system as required and a compressed gas storage for storing an oxygen-reduced gas mixture or inert gas in compressed form. The compressed gas storage is connected or can be connected with regard to flow to (i.e., for fluid communication with) at least one enclosed area via a line system in order to feed at least some of the gas mixture or inert gas stored in the compressed gas storage to the at least one enclosed area as required. In addition, the outlet of the gas separation system is connected or can be connected with regard to flow (i.e., for fluid communication) alternatively to an inlet of the compressed gas storage or to the at least one enclosed space, in order to feed the gas mixture provided at the outlet of the gas separation system to the compressed gas storage and/or the at least one enclosed area as required.

The advantages which can be achieved with the present solution include the fact that in the oxygen-reducing installation, the outlet of the gas separation system can be connected with regard to flow to an inlet of the compressed gas storage and/or to the at least one enclosed space, allowing the gas separation system to acquire a double function. On the one hand the gas separation system serves to feed an oxygen-reduced gas mixture to the spatial atmosphere of the enclosed area in order to lower the oxygen concentration in the spatial atmosphere of the enclosed area (=rapid or first lowering) or to maintain the oxygen concentration at an already lowered level. On the other hand the gas separation system serves for refilling the compressed gas storage as required. This is necessary, for example, if at least some of the oxygen-reduced gas mixture or inert gas stored in compressed form in the compressed gas storage has been passed beforehand into the spatial atmosphere of the enclosed area in order, for example, to lower the oxygen concentration there rapidly to a particular inerted level. Such a rapid lowering by "shooting" an oxygen-reduced gas mixture or inert gas into the spatial atmosphere of the enclosed space is necessary in particular if in the event of a fire or for the purpose of a first lowering, the oxygen concentration in the enclosed space must be lowered as rapidly as possible.

Due to the fact that with the aid of the gas separation system the compressed gas storage can subsequently be filled again with an oxygen-reduced gas mixture, it is no longer necessary to replace the compressed gas storage or even refill it with the aid of an external installation. In particular, the present solution is thus also suitable for enclosed areas which are accessible only with difficulty, such as, for example, remote regions.

In order to be able to optimise the capacity of the gas separation system, i.e. the amount of an oxygen-reduced gas mixture which can be provided per unit time, and match it to the corresponding use, it is advantageous if upstream of the gas separation system there is a compressor system via which an initial gas mixture to be fed to the gas separation system can be compressed accordingly. Depending on the operating manner (VPSA or PSA, described further below), the degree of compression of the initial gas mixture here is 1 to 2 bar or, respectively, 8 to 10 bar. However, other compressions are also conceivable.

In particular, the gas separation system is configured to separate off at least some of the oxygen contained in the initial gas mixture. Generally, there are two types of gas separation systems. The gas separation system according to the first type comprises an inlet for the initial gas mixture, e.g. ambient air, a membrane of tightly bundled synthetic fibers, and an outlet for the oxygen-reduced gas mixture. In operation, usually compressed ambient air flows from the inlet downstream to the outlet, passing the membrane of synthetic fibers. The oxygen is able to pass circumferentially around the fibers and can be discharged to a remote outlet. In contrast, the nitrogen-enriched air flows through the fibers until it reaches the outlet of the gas separation system, from where it can be fed to the enclosed area.

The other type of gas separation system is based on pressure swing adsorption (PSA) or vacuum pressure swing adsorption (VPSA) processes. Generally, this type of gas separation system comprises a compressor system, at least two containers filled with adsorbent, e.g. carbon molecular sieve material, each container with an inlet and an outlet, various lines connecting the components, valves for switching gas flow between the compressor system and the individual containers and optionally a buffer for the oxygen-reduced gas mixture. As the adsorbent needs to be regenerated once it is saturated with oxygen, the containers are operated in a switching or rotating manner. For instance with two containers, always one container is in adsorption mode and the other is in regeneration mode, which are switched once the adsorbent in the container in adsorption mode is saturated with oxygen. The difference between PSA and VPSA systems is the operating pressure range. VPSA systems are operated approximately at atmospheric pressure, while PSA systems are typically operated at higher pressure values, e.g. 6 to 8 bar.

Advantageously, the gas separation system is configured such that operation can be alternatively in a VPSA manner or in a PSA manner.

As already indicated, the term "initial gas mixture" used herein is to be understood generally as meaning a gas mixture which, in addition to the constituent oxygen, in particular also contains nitrogen and optionally also further gases, such as, for example, noble gases. A possible initial gas mixture is, for example, normal ambient air, i.e., a gas mixture which comprises oxygen to the extent of 21 vol. %, nitrogen to the extent of 78 vol. % and other gases to the extent of 1 vol. %. Nevertheless, it is also conceivable for some of the spatial air contained in the enclosed area to be used as the initial gas mixture, fresh air preferably also being admixed to this spatial air content.

A gas separation system operated in a VPSA manner is understood generally as meaning an installation for providing nitrogen-enriched air operating in accordance with the vacuum pressure swing absorption principle (VPSA). According to the invention such a VPSA installation which nevertheless is operated in a PSA manner if required is preferably employed as the gas separation system in the oxygen-reducing installation. The abbreviation "PSA" stands for pressure swing absorption, which is conventionally called the pressure swing absorption technique.

In order to be able to switch the operating manner of the gas separation system from VPSA to PSA, one embodiment of the present invention provides an installation in which the degree of compression of the initial gas mixture effected by the compressor system upstream of the gas separation system is increased accordingly. In particular, this embodiment provides an installation in which if the amount of an oxygen-reduced gas mixture to be provided per unit time at the outlet of the gas separation system must be increased, the degree of compression is increased, in particular to a value which depends on the amount of the oxygen-reduced gas mixture to be provided per unit time.

The increase in the compression of the initial gas mixture created by the compressor system takes place in particular in the event of a fire, i.e. when, for example, a fire parameter is detected in the spatial atmosphere of the enclosed area, or when for another reason the oxygen content in the spatial atmosphere of the enclosed area is to be further reduced briefly compared with a previously set or maintained oxygen content. On the other hand, the increase in the compression created by the compressor system also takes place, for example, when the compressed gas storage must be refilled with an oxygen-reduced gas mixture. A further reason for the need of increased compression may be an increased leakage rate of the enclosed area, e.g. due to higher wind forces impacting on the enclosed area.

According to a further aspect of the present invention, a compressor system is provided between the outlet of the gas separation system and the inlet of the compressed gas storage in order to compress as required the oxygen-reduced gas mixture provided at the outlet of the gas separation system and to be fed to the compressed gas store. Such a compression is necessary, for example, if the pressure of the gas mixture provided at the outlet of the gas separation system is not sufficient to achieve the compression desired for storage of the gas mixture in the compressed gas store.

The compressor system which is provided as required in order to further compress accordingly the oxygen-reduced gas mixture provided at the outlet of the gas separation system and to be fed to the compressed gas storage is preferably configured as a movable system which can also be removed completely from the oxygen-reducing installation as required and in particular if filling of the compressed gas storage is not necessary or is not carried out.

In this connection it would be conceivable, for example, for the compressor system configured as a movable system to be mounted or mountable on a transport palette or the like in a construction which is movable and/or loadable with a floor conveyor apparatus, e.g. lifting truck or forklift, in order to make possible an easiest possible removal of the compressor from the oxygen-reducing installation. In practice filling of the compressed gas storage is only occasionally necessary; the configuration of the compressor system as a movable system allows this compressor system to be employed with different oxygen-reducing installations, optionally also arranged at a distance from one another, in order to compress there accordingly, as required, the oxygen-reduced gas mixture to be fed to a compressed gas storage to be filled.

It is to be emphasised here that according to one embodiment for refilling the compressed gas storage the oxygen-reduced gas mixture is provided in particular by a gas separation system, wherein the compressed gas storage in particular is a compressed gas cylinder or a battery of compressed gas cylinders. Furthermore, it is likewise possible that the compressed gas storage has an arbitrary shape taking into account the spatial conditions on-site, thus allowing an optimum use of the available space.

In this connection it is also conceivable and advantageous for the gas separation system also or the gas separation system only to be configured as a movable system which can be removed from the oxygen-reducing installation (on site) as required.

As already stated in connection with the compressor system, the term "movable system" is understood herein as meaning in particular a component which is integrated into the oxygen-reducing installation such that this component can be removed from the installation without a relatively great outlay. In particular, it is appropriate here for the component to be configured such that it can be moved with a floor conveyor apparatus or the like.

In one embodiment of the oxygen-reducing installation, this has a valve system having a first, a second and a third valve arrangement. The first valve arrangement is constructed such as to form or to separate a flow connection between the outlet of the gas separation system and the inlet of the compressed gas storage as required. The second valve arrangement of the valve system is constructed such as to form or to separate a flow connection between the outlet of the compressed gas storage and the at least one enclosed area as required, while the third valve arrangement is constructed such as to form or to separate a flow connection between the outlet of the gas separation system and the at least one enclosed area as required.

In a manner which is particularly effective, an installation is preferably provided here in which the inlet of the compressed gas storage and the outlet of the compressed gas storage are connected to the inside of the compressed gas storage via a preferably common connector piece, in particular in the form of a T or Y piece.

For coordinated actuation of the individual valve arrangements of the valve system the oxygen-reducing installation according to the invention preferably has a control device. This control device is constructed in particular to actuate the individual valve arrangements of the valve system such that the outlet of the gas separation system is connected with regard to flow to the inlet of the compressed gas storage only when no flow connection is present between the outlet of the compressed gas storage and the at least one enclosed area and/or when no flow connection is present between the outlet of the gas separation system and the at least one enclosed area. In this connection it is also conceivable, however, for a different priority to be imposed, e.g. simultaneous flow connections between the compressed gas storage and the outlet of the gas separation system as well as between the compressed gas storage and the at least one enclosed area.

The control device is a combined hardware/software device. Input signals, such as sensor measurements or user configuration inputs, may be processed and calculated with a control software, e.g. WAGNER OxyControl™. The control device may include a programmable logic control (PLC), such as available as S7 by Siemens AG, Munich, Germany or as type 750 by WAGO Kontakttechnik GmbH, Minden, Germany. The control device is configured to receive sensor data, to provide information, e.g. by displaying or submitting status or alarm data, to actuate the compressor systems and the gas separation system and to actuate the valve arrangements. In one embodiment, the valve arrangements comprise both electromagnetic control valves and pneumatic area valves. The control device is configured to generate and to submit electrical actuation signals in order to actuate the electromagnetic control valves. The control valves are in turn connected to a control gas source, e.g. a control gas cylinder. As soon as the control valves are actuated, control gas flows out of the control gas cylinder and actuates the pneumatic area valves as required.

In a further embodiment, an additional fire alarm control panel is provided as a secondary control device. The fire alarm control panel is configured to receive fire detection data by corresponding fire detectors, to process fire alarm data and to signal a fire alarm. An exemplary available fire alarm control panel can be ordered at Labor Strauss Sicherungsanlagenbau GmbH, Vienna, Austria.

Both the control device and the fire alarm control panel may be configured to actuate alarm devices in case of possibly dangerous conditions, e.g. smoke, fire or critical oxygen concentrations.

According to a further aspect of the oxygen-reducing installation a sensor unit is assigned to the control device. Preferably, the sensor unit comprises at least one pressure sensor and/or at least one temperature sensor. In particular, the pressure sensor and/or the temperature sensor measure the state, in particular the filling level or filling degree of the compressed gas store. During refilling of the compressed gas storage with oxygen-reduced gas mixture, the temperature in the compressed gas storage may increase, thus leading to an incomplete refilling of the compressed gas storage with oxygen-reduced gas mixture at the time after refilling, when the temperature and thereby also the pressure decrease.

Advantageously, with the aid of the at least one pressure sensor and/or the at least one temperature sensor, in particular provided in and/or on the compressed gas store, it is possible to consider temperature-sensitive pressure conditions, e.g., with respect to a preferably automatic refilling of the compressed gas storage with oxygen-reduced gas mixture via the control device. In this regard, it is also conceivable that in answer to a temperature-dependent pressure increase, the control device controls the discharge of oxygen-reduced gas mixture from the compressed gas store, thus preventing a damage of the compressed gas store.

In one embodiment of the oxygen-reducing installation, the at least one gas separation system and/or the compressor system installed upstream of the gas separation system comprises a first operational mode and a second operational mode for feeding the oxygen-reduced gas mixture to the compressed gas storage and/or to the at least one enclosed area as required. Preferably, one independent gas separation system is assigned to each operational mode. In this manner, the first and second operational modes are individually or simultaneously operable by means of independent gas separation systems. For this, the gas separation system or the operational mode of the at least one gas separation system and/or of the compressor system installed upstream of the gas separation system is preferably, in particular automatically, controlled by the control device. In this regard it should be noted that the refilling of the compressed gas storage with an oxygen-reduced gas mixture typically is effected with a higher nitrogen concentration than required for feeding to the enclosed area.

In this manner the oxygen-reduced gas mixture produced at a first operational mode of the gas separation system with a high nitrogen concentration, preferably with a nitrogen concentration of 99.5 percent by volume, can be used as required both for refilling of the compressed gas storage and for simultaneously providing the enclosed area with an oxygen-reduced gas mixture, which is dilutable to a nitrogen concentration of 95 percent by volume for this purpose. Furthermore the control device provides the opportunity to operate the gas separation system at a second operational mode in which an oxygen-reduced gas mixture with an effectual nitrogen concentration, preferably a nitrogen concentration of 95 percent by volume, is provided for being fed to the enclosed area.

For instance, it is conceivable that at refilling the compressed gas storage with a high nitrogen concentration a part of the generated oxygen-reduced gas mixture is fed to the enclosed area via a bypass. For instance, the flow connection between the outlet of the gas separation system and the enclosed area can be used as a bypass in connection with the third valve arrangement. For this purpose, the bypass preferably comprises an appropriate baffle for reducing the nitrogen concentration of the oxygen-reduced gas mixture to be fed to the enclosed area to an effectual level, e.g. by intermixing it with an initial gas mixture. By way of the advantageous control of the gas separation system, preferably automatically by the control device, the gas separation system can be operated efficiently and the oxygen-reduced gas mixture can be optimally used according to the provided concentration.

Furthermore, by application of two gas separation systems, it is possible to operate one gas separation system in a first operational mode to refill the compressed gas storage and to operate preferably in parallel the other gas separation system in a second operational mode to provide the enclosed area with an oxygen-reduced gas mixture with an effectual nitrogen concentration. It is both conceivable to provide either a common or an individual upstream compressor system for each of the gas separation systems.

According to a further aspect of the oxygen-reducing installation an installation is provided in which the compressed gas storage has a plurality of compressed gas containers spatially separated from one another, connected parallel to one another and preferably each with at least one container valve. In addition, a first and a second collecting line are provided. In this context the outlet of the gas separation system is connected or can be connected to the first collecting line via a valve, while for preferably each of the plurality of compressed gas containers a first line section is provided, via which the particular container valve of the one or more compressed gas containers is connected with regard to flow to the first collecting line. The container valve of preferably each one of the plurality of compressed gas containers is furthermore in each case connected with regard to flow to the second collecting line already mentioned via a second line section. The second collecting line itself is connected or can be connected with regard to flow to the at least one enclosed area via a valve, in particular an area valve.

In this embodiment the valve via which the outlet of the gas separation system is connected or can be connected to the first collecting line forms the previously mentioned first valve arrangement. On the other hand, the valve via which the second collecting line is connected or can be connected with regard to flow to the at least one enclosed area is a part of the second valve arrangement if the oxygen-reducing installation is assigned to several enclosed areas. If on the other hand the oxygen-reducing installation is assigned to only a single enclosed area, the valve via which the second collecting line is connected or can be connected with regard to flow to the at least one enclosed area forms the second valve arrangement.

According to a further embodiment a plurality of compressed gas containers in the form of compressed gas cylinders or with an arbitrary geometric shape are connected with each other with regard to flow, e.g. by flexible hose connections or by rigid connections like pipe connections, whereas for a combination of a plurality of compressed gas containers, a common container valve can be provided. In this manner, in particular for compressed gas containers with arbitrary shapes and adjusted shapes for the respective spatial conditions, the possibility for an optimal use of the available space is provided and the number of container valves to be controlled is reduced as required.

The oxygen-reducing installation according to the invention is suitable in particular for reducing or maintaining at a reduced value the oxygen content in the spatial atmosphere in several areas spatially separated from one another. According to one embodiment of the present invention the oxygen-reducing installation is therefore assigned to a plurality of areas spatially separated from one another, wherein the second valve arrangement already mentioned has for each of the plurality of areas an assigned valve (in particular, an area valve) via which the second collecting line is connected or can be connected with regard to flow to the corresponding area in order to feed an oxygen-reduced gas mixture or inert gas to this area as required.

According to a further embodiment of the oxygen-reducing installation the control device controls the individual valve arrangements in such a coordinated manner that the outlet of the at least one gas separation system can be connected with the inlet of at least one compressed gas container with regard to flow when the outlet of at least one further compressed gas container is connected with the at least one enclosed area with regard to flow. Accordingly the control device, in particular in connection with the sensor unit, is configured to selectively refill compressed gas containers with an oxygen-reduced gas mixture while an oxygen-reduced gas mixture from further compressed gas containers is fed to at least one enclosed area.

Thus advantageously a resource-preserving and time-saving refilling of the compressed gas storage with an oxygen-reduced gas mixture is provided, while simultaneously a concentration or a concentration control range of an oxygen-reduced gas mixture can be held in the enclosed area. Furthermore, an improved reliability of the oxygen-reducing installation due to selective refilling and control of the compressed gas containers by way of the control device is provided.

In one embodiment of the oxygen-reducing installation the control device is configured to selectively connect the outlet of the gas separation system and at least one selected compressed gas container with regard to flow when a predefined minimum pressure and/or falling below a predefined minimum pressure is detected in at least one of the plurality of compressed gas containers. The minimum pressure is freely selectable and is suitable to indicate an at least partial or complete discharge of a compressed gas container. Thus the control device can determine a user-defined status or threshold level for refilling a compressed gas container or the compressed gas storage based on a minimum pressure and, if necessary, initiate an appropriate refilling process. Hence, a resource-saving refilling of the compressed gas containers or the compressed gas storage is provided. Furthermore it is in this manner possible to detect leakages e.g. of the compressed gas store, when the control device detects a minimum pressure or a drop below this minimum pressure in at least one compressed gas container with the sensor unit and preferably automatically starts a refilling of the compressed gas containers with oxygen-reduced gas mixture.

The invention is not limited only to an oxygen-reducing installation, but also relates to a method of operating an oxygen-reducing installation, in particular an oxygen-reducing installation of the type according to the invention described previously. In the method a procedure is provided in which an oxygen-reduced gas mixture or inert gas is first stored in compressed form in a compressed gas store. For rapid reduction of the oxygen content in the spatial atmosphere of an enclosed area, at least some of the gas mixture or inert gas stored in compressed form in the compressed gas storage is fed to the enclosed area, and indeed by connecting the compressed gas storage with regard to flow to the enclosed area. In order to maintain a reduced oxygen content in the spatial atmosphere of the enclosed area and/or in order to further reduce the oxygen content in the spatial atmosphere of the enclosed area, an oxygen-reduced gas mixture provided at an outlet of a gas separation system is fed to the enclosed area in a controlled manner, and indeed by connecting the outlet of the gas separation system with regard to flow to the enclosed area.

In the operating method it is envisaged in particular that after the first lowering or rapid lowering of the oxygen content in the enclosed area by feeding in the gas mixture or inert gas compressed in the compressed gas store, a refilling of the compressed gas storage at least partially takes place, and indeed by connecting the outlet of the gas separation system with regard to flow to the compressed gas store.

According to a further aspect, a control device is provided which in particular is constructed such that the filling of the compressed gas storage is coordinated or regulated by monitoring. The at least partial refilling of the compressed gas storage can be particularly performed while simultaneously the reduced oxygen concentration in the enclosed area is maintained and/or further reduced. In this context, this aspect is based on the finding that when filling the compressed gas store, in particular if this is configured in the form of a battery of compressed gas cylinders, various conditions must be met in order to fill the individual compressed gas cylinders of the battery of cylinders correctly and reliably with the gas provided by the gas separation system.

Merely as an example there may be mentioned in this connection that there are various cylinder filling pressures for compressed gas cylinders. If a compressed gas cylinder is filled with the incorrect pressure, the cylinder is not filled completely, or an excess pressure arises, which may damage the compressed gas cylinder (for example an excess pressure disc on the cylinder can then break).

A first example of an embodiment of the oxygen-reducing installation 100 shown as a diagram in FIG. 1 is distinguished in particular in that this has a gas separation system 102 and in addition to this a compressed gas storage 105. The gas separation system 102 and the compressed gas storage 105 together form the "inert gas source" of the oxygen-reducing installation 100.

The gas separation system 102 has a compressor system 101 installed upstream in order to compress accordingly the initial gas mixture to be fed to the gas separation system 102. By appropriately varying the pressure and volume stream of the initial gas mixture fed to the gas separation system 102, the gas separation system 102 can be adjusted to a required nitrogen purity and necessary amount of oxygen-reduced gas.

At this point it is to be emphasised, however, that it is not absolutely necessary for the gas separation system 102 to have a corresponding compressor system 101 installed upstream.

The outlet of the gas separation system 102, i.e., the exit of the gas separation system 102 at which the oxygen-reduced gas mixture or nitrogen-enriched gas mixture is provided, is connected or can be connected with regard to flow with an enclosed space 107 via a first line system, and is connected or can be connected to the compressed gas storage 105 already mentioned via an additional, second line system. For this a first valve arrangement 104 is provided in the second line system, i.e. in the line system which connects the outlet of the gas separation system 102 to the compressed gas storage 105. A further valve arrangement 109 is provided in the line system which connects with regard to flow the outlet of the gas separation system 102 to the enclosed space 107. Another valve arrangement 106 is arranged in a line system which connects the compressed gas storage 105 to the enclosed area 107. In this manner the compressed gas storage 105 can be connected with regard to flow to the enclosed area 107 as required.

A control device 10 is preferably assigned to the oxygen-reducing installation 100 in order to be able to actuate in coordination the individual valve arrangements 104, 106 and 109. Furthermore, preferably a sensor unit with at least one pressure sensor and/or at least one temperature sensor which are in particular located in or on the compressed gas storage is assigned to the control device 10. For sake of clarity, a sensor unit is not shown in FIGS. 1 to 4.

In detail, the example of an embodiment shown provides an installation in which the control device 10 is constructed to actuate the individual valve arrangements 104, 106 and 109 such that the outlet of the gas separation system 102 is connected or can be connected with regard to flow to the inlet of the compressed gas storage 105 preferably only when no flow connection is present between the outlet of the compressed gas storage 105 and the at least one enclosed area 107, i.e. when the third valve arrangement 106 is closed. Furthermore, the control device 10 is constructed such that the outlet of the gas separation system 102 is connected or can be connected with regard to flow to the compressed gas storage 105 via the first valve arrangement 104 preferably only when no flow connection is present between the outlet of the gas separation system 102 and the enclosed area 107, that is to say when the second valve arrangement 109 is closed.

Alternatively it is also conceivable that the oxygen-reducing installation 100 according to the invention, in particular control device 10, is configured in such a manner that the outlet of the gas separation system 102 is connected or can be connected with regard to flow with the inlet of the compressed gas storage 105 via the first valve arrangement 104 and with the enclosed area 107 via the third valve arrangement 106 simultaneously as required.

In the example of an embodiment of the oxygen-reducing installation 100 according to the invention shown as a diagram in FIG. 1 a further compressor system 103 is provided, which is arranged in the line system which connects the outlet of the gas separation system 102 to the compressed gas container 105. With the aid of this further compressor system 103 the oxygen-reduced gas mixture provided at the outlet of the gas separation system 102 can be further compressed as required, so that this can then be stored in the desired compressed form in the compressed gas container 105. If a compressed gas cylinder or battery of cylinders is employed as the compressed gas container, it is advantageous if the further compressor system 103 compresses the oxygen-reduced gas mixture provided at the outlet of the gas separation system 102 to up to 300 bar.

Figure 2:
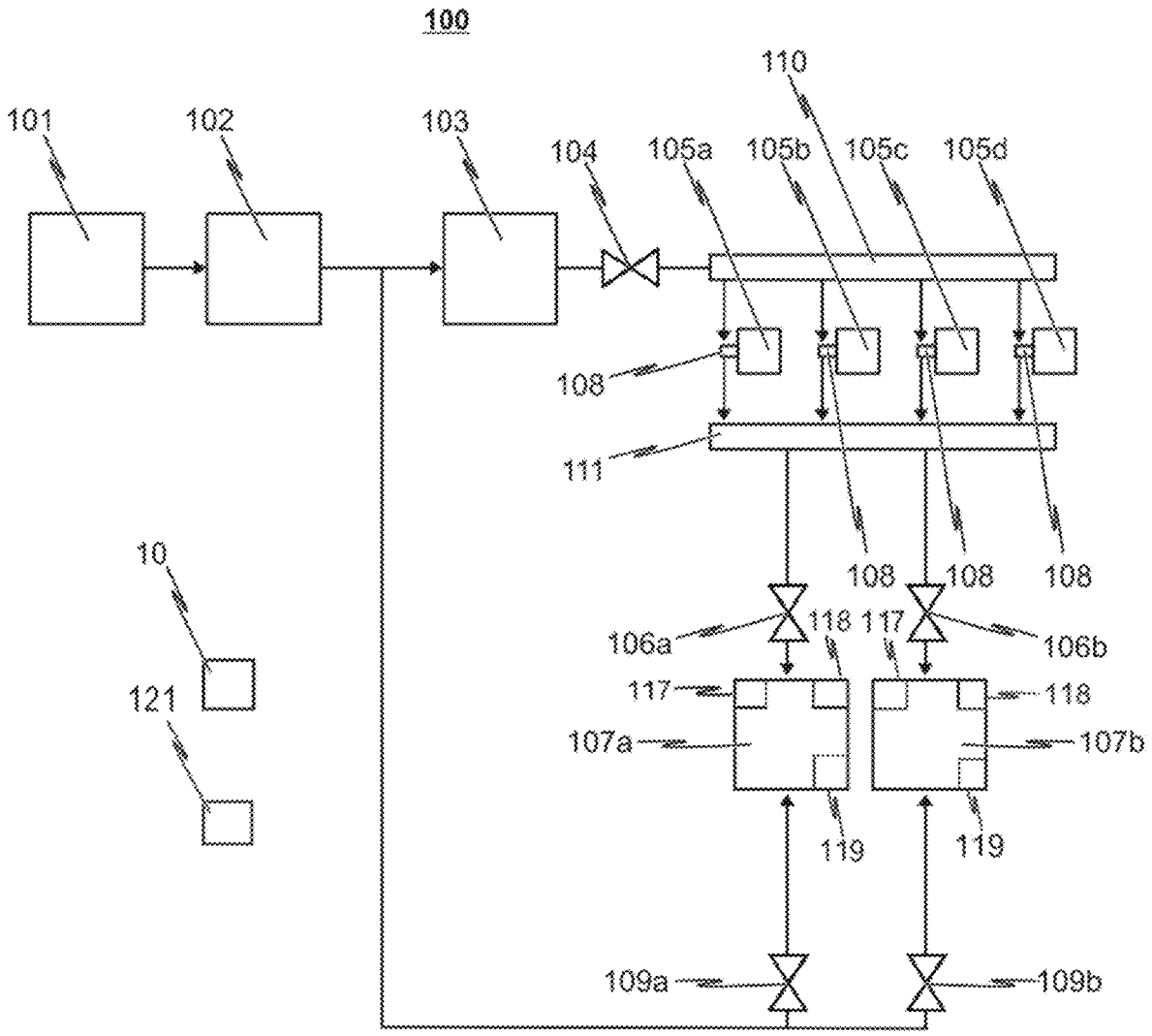
FIG. 2 a diagram of a second example of an embodiment of the oxygen-reducing installation according to the invention.

The oxygen-reducing installation 100 shown as a diagram in FIG. 2 differs from the embodiment shown as a diagram in FIG. 1 in particular in that the oxygen-reducing installation 100 according to the embodiment shown in FIG. 2 is assigned not to only a single enclosed area 107 but to a plurality of enclosed areas 107*a*, 107*b*. The oxygen-reducing installation 100 is thus configured as a so-called multiple area installation.

A further difference from the embodiment shown in FIG. 1 lies in the fact that in the oxygen-reducing installation 100 shown as a diagram in FIG. 2 the compressed gas storage 105 has a plurality of compressed gas containers 105*a*, 105*b*, 105*c*, 105*d* spatially separated from one another and connected parallel to one another. These compressed gas containers are, for example, commercially obtainable high pressure cylinders (300 bar cylinders).

The individual compressed gas containers 105*a* to 105*d* are connected parallel to one another in order to be able to feed the gas mixture stored in compressed form in these compressed gas containers 105*a* to 105*d* as rapidly as possible to the enclosed areas 107*a*, 107*b* as required.

In the embodiment shown as a diagram in FIG. 2 a first collecting line 110 and a second collecting line 111 are employed for the parallel connection of the compressed gas containers 105*a* to 105*d*. The first collecting line 110 can be connected with regard to flow to the outlet of the gas separation system 102 via the first valve arrangement 104.

As also in the embodiment shown as a diagram in FIG. 1, in the oxygen-reducing installation 100 shown in FIG. 2 a further valve arrangement is employed, in order to connect the outlet of the gas separation system 102 to the first enclosed area 107*a* and/or the second enclosed area 107*b* as required. In contrast to the embodiment shown as a diagram in FIG. 1, on the other hand, this valve arrangement has two valves 109*a* and 109*b* in total, which are each constructed as an area valve and assigned to one of the corresponding enclosed areas 107*a*, 107*b*.

The second collecting line 111 already mentioned likewise can be connected with regard to flow to the corresponding enclosed areas 107*a*, 107*b* via corresponding area valves 106*a*, 106*b*. These valves 106*a*, 106*b* are preferably likewise constructed as area valves.

Oxygen sensors 117 are located in the enclosed areas 107*a*, 107*b* in order to monitor the oxygen concentration in the enclosed areas 107*a*, 107*b* and to send the measurement data to control device 10. Aspirating smoke detectors 118 are also present in the enclosed areas 107*a*, 107*b* in order to detect possible fires. The smoke detectors 118 are connected with wires or wirelessly to a fire alarm panel 121 which is independent from control device 10. The fire alarm panel 121 is configured to activate alarm devices 119 and to send alarm messages to predefined addresses as well as to control device 10.

The parallel connection of the individual compressed gas containers 105*a* to 105*d* is also described in more detail in the following with reference to the diagram shown in FIG. 3.

Figure 3:
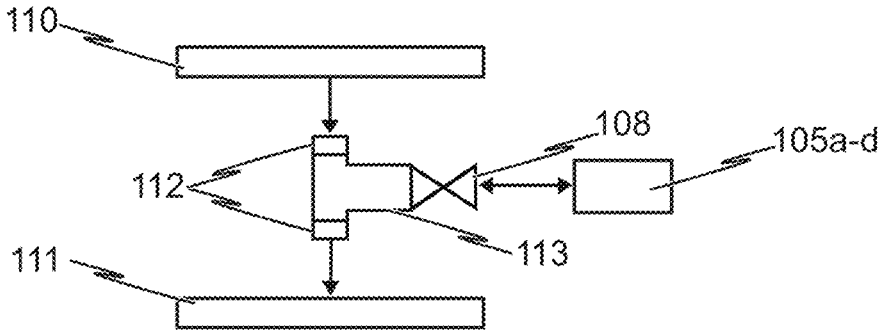
FIG. 3 a diagram of a container valve arrangement via which in the examples of embodiments the particular compressed gas containers are connected or can be connected to the first and second collecting line of the oxygen-reducing installation.

In detail, in the embodiment shown as a diagram in the drawings each compressed gas container 105*a* to 105*d* is provided with a corresponding container valve 108 (cf. FIG. 3). Each container valve 108 of the compressed gas containers 105*a* to 105*d* is connected with regard to flow on the one hand to the first collecting line 110 via a first line section and on the other hand to the second collecting line 111 via a second line section.

For this purpose a connector piece, in particular in the form of a T or Y piece 113, is assigned to each container valve 108 of the compressed gas containers 105*a* to 105*d*, via which the corresponding first line section on the one hand and the corresponding second line section on the other hand are connected with regard to flow to the corresponding container valve 108 or the inside of the compressed gas container 105*a* to 105*d*.

Advantageously, the container valves 108 of the compressed gas containers 105*a* to 105*d* are in each case configured as a quick-release valve arrangement, in particular as a pneumatically actuatable quick-release valve arrangement, in order to form a flow connection between the corresponding compressed gas container 105*a* to 105*d* and the second collecting line as required. It is advantageous here if the valve function of the quick-release valve arrangement can also be switched off as required, and indeed in particular if the outlet of the gas separation system 102 is connected or to be connected to the inlet of the corresponding compressed gas container 105*a* to 105*d* for the purpose of refilling.

As indicated in the diagram in FIG. 3, it is furthermore advantageous if at least one backflow preventer 112 is provided between the container valve 108 of the corresponding compressed gas containers 105*a* to 105*d* and the first collecting line 110 and/or the second collecting line 111, and in particular the first and/or second line section, in order to block a gas flow from the second collecting line 111 back to the compressed gas containers 105*a* to 105*d* and/or from the compressed gas containers 105*a* to 105*d* back to the first collecting line 110. According to FIG. 3 two backflow preventers 112 are directly mounted to the connecting piece, especially T piece 113, and connected with regard to flow to container valve 108 of the corresponding compressed gas container 105*a* to 105*d*. Consequently, the inlet of the compressed gas storage and the outlet of the compressed gas storage are connected with the interior of the compressed gas storage via the preferably common connecting piece. In this manner it is ensured that when the quick-release valve arrangements are released no backflow can take place from the second collecting line 111 into one of the compressed gas containers 105*a* to 105*d* if, for example, a lower pressure is present in one of the compressed gas containers 105*a* to 105*d* compared with the other compressed gas containers.

Figure 4:
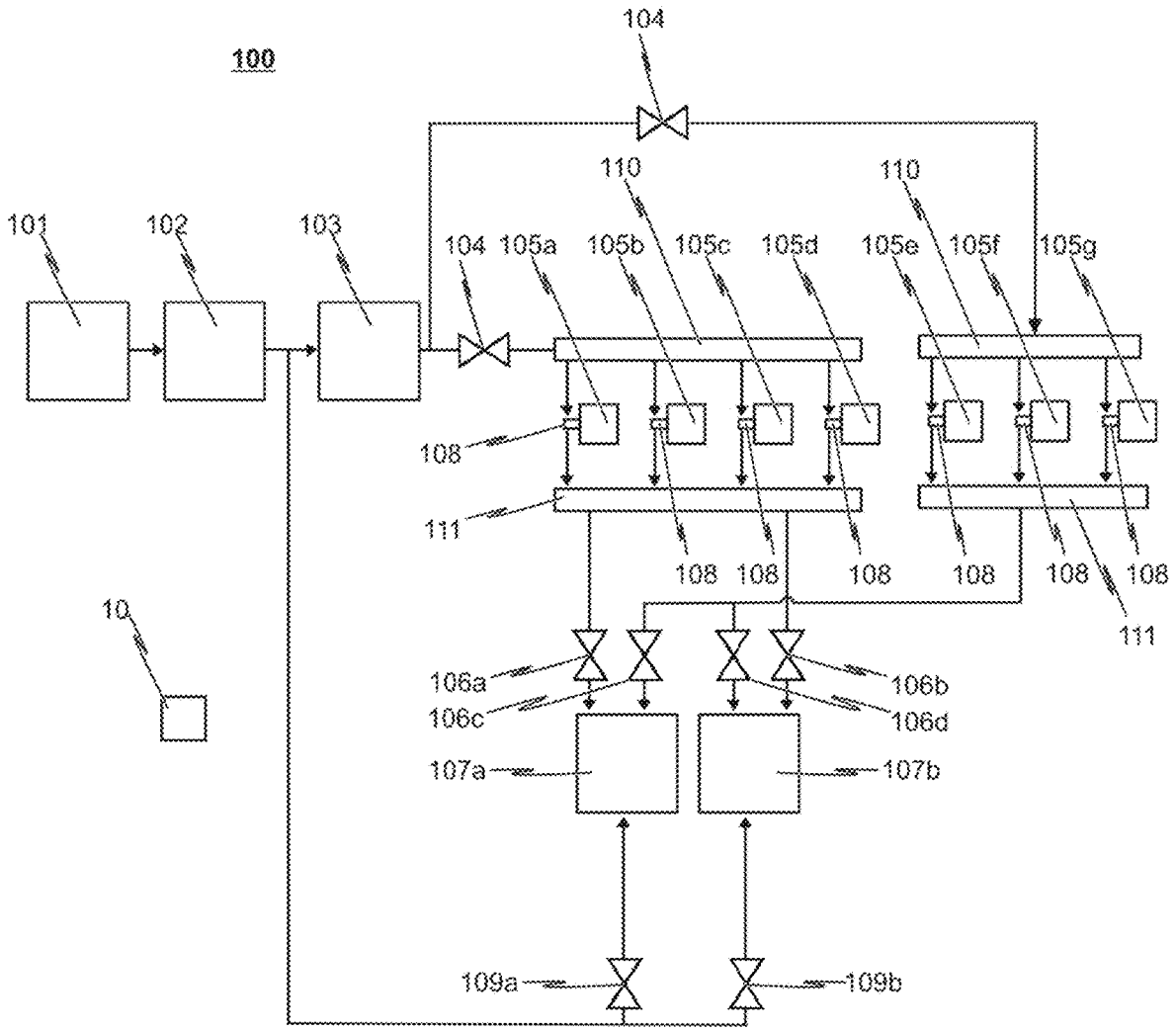
FIG. 4 a diagram of a third example of an embodiment of the oxygen-reducing installation according to the invention.

The embodiment shown in FIG. 4 differs from the embodiment shown in FIG. 2 particularly by further compressed gas containers 105*e* to 105*g* being connectable with regard to flow to the inlet of the gas separation system via a further valve of the first valve arrangement 104. In this embodiment, the control device according to the invention is configured to control several valves of the first valve arrangement 104.

In the same way as for the compressed gas containers 105*a* to 105*d* shown in FIG. 2, a further first collecting line 110 and a further second collecting line 111 are assigned to the further compressed gas containers 105*e* to 105*g*. Likewise, a container valve 108 with a connecting piece, particularly a T or Y piece 113, is assigned to each of the further compressed gas containers 105*e* to 105*g*, via which the corresponding first line section and the corresponding second line section is connectable with regard to flow to the container valve 108 respectively to the interior of the further compressed gas containers 105*e* to 105*g*.

The further second collecting line 111 is likewise connectable with regard to flow to the corresponding enclosed areas 107*a*, 107*b* by means of corresponding area valves 106*c*, 106*d*.

The advantage of the embodiment shown in FIG. 4 is that the further compressed gas containers 105*e* to 105*g* and the compressed gas containers 105*a* to 105*d* are preferably independently applicable and controlled by control device 10. In particular the further compressed gas containers 105*e* to 105*g* are refillable after a rapid or first lowering, while the compressed gas containers 105*a* to 105*d* are simultaneously connected with regard to flow to the enclosed areas 107*a*, 107*b* in order to maintain or further reduce a reduced oxygen concentration in the enclosed areas 107*a*, 107*b*.

It is of course also conceivable that the compressed gas containers 105*a* to 105*d* are refilled with oxygen reduced gas mixture by the gas separation system 102, whereas the further compressed gas containers 105*e* to 105*g* are connected with regard to flow to the enclosed areas 107*a*, 107*b*. Furthermore, use of further compressed gas containers 105*e* to 105*g* is not limited to the number of compressed gas containers shown in FIG. 4, but can rather be extended to further compressed gas containers or to further batteries of further compressed gas containers as required.

Figure 5:
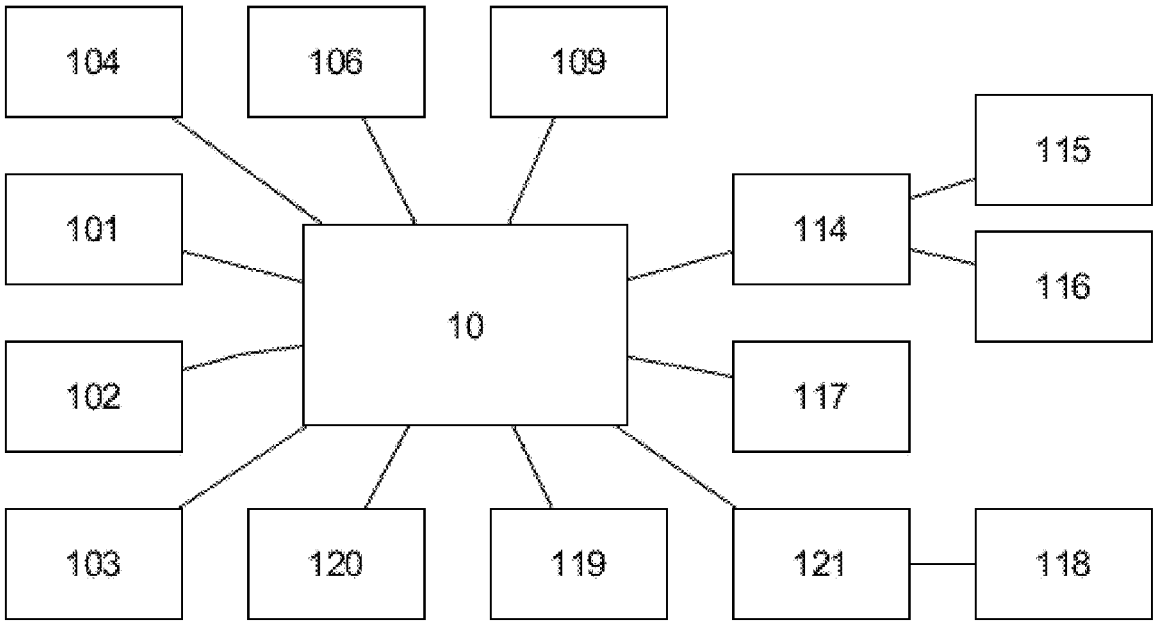
FIG. 5 a block diagram showing an example of an embodiment of the control device and the components connected to it.

FIG. 5 shows a block diagram to indicate various exemplary connections of control device 10 to components of the oxygen-reducing installation according to one embodiment. The control device 10 receives input by various sensors. Sensor unit 114 provides control device 10 with data by temperature sensor 115 and pressure sensor 116 located in or on the compressed gas container 105. By calculating the temperature and pressure data the control device 10 may provide a more precise refilling in answer to a temperature-dependent pressure increase in the compressed gas container 105. Furthermore, pressure sensor 116 enables control device 10 to detect a pressure decrease in the compressed gas container 105, which could be a trigger condition for starting to refill it. Oxygen sensor 117 provides oxygen concentration measurements in the enclosed area 107*a*, 107*b* to the control device 10, thereby allowing control of the activation or deactivation of the gas separation system 102 and/or the upstream compressor system 101 in dependence of the current oxygen concentration. An optional fire alarm panel 121 may also be connected to control device 10 in order to trigger a fire alarm mode of control device 10, the fire alarm mode for instance comprising triggering the extinguishing mode of the oxygen-reducing installation. A smoke detector, which is in this case an aspirating smoke detector 118 in order to enable earliest detection of smoke in the enclosed area, is configured to submit alarm information to fire alarm panel 121 if smoke or a fire is detected in the enclosed area. In case of possibly dangerous conditions, e.g. smoke, fire or critical oxygen concentrations, the control device 10 and the fire alarm panel are configured to trigger alarm devices 119. Via a user interface 120 it is possible to display information available in the control device 10, e.g. status or alarm information, and to perform user inputs intended for the control device 10, e.g. configuration inputs. The control device 10 is furthermore connected to upstream compressor system 101 in order to activate or deactivate it or to increase or decrease the degree of compression of upstream compressor system 101. The control device 10 is furthermore connected to downstream compressor system 103 in order to activate it for refilling of the compressed gas container 105 and to deactivate it upon completion of refilling. In order to enable the control device 10 to control the modes of base inerting, rapid lowering of the oxygen concentration and refilling, the control device 10 is connected to valves 104, 106 and 109 and can change the on or off position of the valves 104, 106 and 109.

Figure 6:
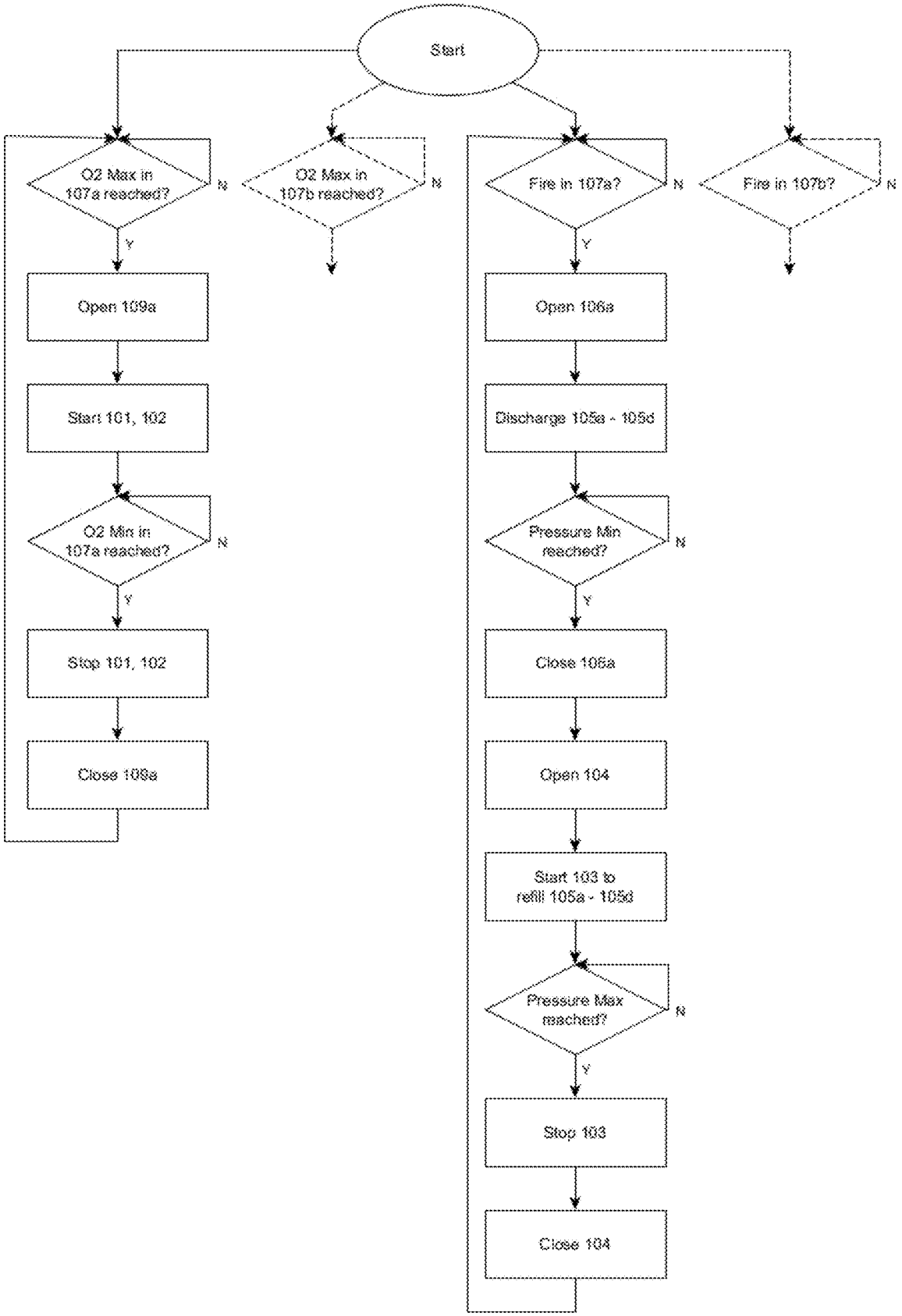
FIG. 6 a flow chart showing an exemplary sequence of control steps.

FIG. 6 shows a flow chart of an exemplary control sequence for controlling an oxygen-reducing installation as shown, for instance, in FIG. 2. The left branch shows a sequence for first lowering and/or maintaining an oxygen-reduced concentration in the enclosed areas 107*a*, 107*b*. The right branch shows a sequence for fire detection, fire extinguishing and refilling of the compressed gas containers 105*a* to 105*d*.

Both sequences are exemplarily shown for the enclosed area 107*a*. Similar sequences are of course conceivable for the enclosed area 107*b*. Both sequences shown in the left and the right branch are intended to occur in parallel.

The following description is dedicated to the left branch. During operation of the oxygen-reducing installation, the oxygen concentration in the enclosed areas 107*a*, 107*b* is continuously measured and the measured data are delivered to control device 10. When a predefined maximum concentration of oxygen is reached, the control device 10 opens valve 109*a* and starts the upstream compressor system 101 as well as the gas separation system 102 in order to feed an oxygen-reduced gas mixture to the enclosed area 107*a*. As soon as a predefined minimum concentration of oxygen is reached, the control device 10 stops the upstream compressor system 101 and the gas separation system 102 and closes valve 109*a*.

As the oxygen concentration will naturally raise due to leakages in the enclosed areas 107*a*, 107*b*, it will sooner or later reach a maximum concentration, so that a restart of upstream compressor system 101 and gas separation system 102 is triggered. Minimum and maximum concentrations may be defined individually and stored in the control device 10. An exemplary minimum concentration could be 17.0% and an exemplary maximum concentration could be 17.4%, which would correspond to a typical base inerting range. A further example comprises lower and upper limits at 14.0% and 14.4%, which would correspond to a typical full inerting range. The minimum and maximum concentrations can also be variably defined for a day and a night mode, wherein the day mode represents a time with high human traffic in the enclosed area, for which a higher oxygen concentration could be required, and wherein the night mode represents a time when only a few or no humans enter the enclosed area, which would allow for a lower oxygen concentration in order to increase fire prevention efficiency.

The following description is dedicated to the right branch showing the interaction between fire detection, fire extinguishing and refilling. Fire detection could be implemented by use of an aspirating smoke detector, thereby realizing a very sensible, reliable and optically attractive fire detection. If a fire is detected in the enclosed area 107*a*, the detection signal is transferred from fire alarm panel 121 to control device 10. Consequently, the control device 10 opens valve 106*a* and triggers the compressed gas containers 105*a* to 105*d* to be discharged via collector line 111 and valve 106*a*, so that the oxygen-reduced gas mixture stored in the compressed gas containers 105*a* to 105*d* rapidly enters the enclosed area 107*a* and thereby extinguishes the fire. As the compressed gas containers 105*a* to 105*d* are discharged, the pressure decreases in the containers 105*a* to 105*d*. The container pressure is continuously measured and the measured data are delivered to control device 10. As soon as the pressure reaches a minimum, the extinguishing mode is completed by closing the valve 106*a*. Consequently, the refilling mode starts by opening valve 104 and starting downstream compressor system 103. The compressed gas containers 105*a* to 105*d* are refilled until the pressure reaches a predefined maximum. In a preferred embodiment, the pressure measurements are subject to a temperature compensation. This is accomplished by both measuring pressure and temperature in the compressed gas containers 105*a* to 105*d* and by calculating a normalized pressure in accordance with thermodynamic formulas. Minimum and maximum pressure may be defined individually and stored in the control device 10.

The refilling mode is completed by stopping downstream compressor system 103 and closing valve 104 by control device 10. The system returns to listening for fire alarm signals for the enclosed areas 107*a*, 107*b*.

The invention is not limited to the embodiments of the oxygen-reducing installation 100 shown as diagrams in the drawings, but results from a combined view of all the features disclosed herein.

In particular in this connection it is also conceivable for an intermediate storage also to be provided directly at the outlet of the gas separation system in order to intermediately store the oxygen-reduced gas mixture provided at the outlet of the gas separation system.

A further example of use which may be mentioned for the oxygen-reducing installation or method described herein is that of providing training conditions for hypoxia training in an enclosed space in which the oxygen content is reduced. In such a space training under artificially produced altitude conditions, which is also called "normobaric hypoxia training", is possible.

A further example of use which may be mentioned is storage of objects, in particular foodstuffs, preferably pomaceous fruit, under a so-called controlled atmosphere (CA), in which inter alia the percentage proportion of atmospheric oxygen is controlled in order to slow down the aging process of readily perishable goods.

It will be appreciated that the various features of the embodiments described herein can be combined in a variety of ways. For example, a feature described in conjunction with one embodiment may be included in another embodiment even if not explicitly described in conjunction with that embodiment.

The present invention has been described in conjunction with certain preferred embodiments. It is to be understood that the invention is not limited to the exact details of construction, operation, exact materials or embodiments shown and described, and that various modifications, substitutions of equivalents, alterations to the compositions, and other changes to the embodiments disclosed herein will be apparent to one of skill in the art.

LIST OF REFERENCE SYMBOLS

10 Control device
100 Oxygen-reducing installation

101 Upstream compressor system
102 Gas separation system
103 Downstream compressor system
104 First valve arrangement
105 Compressed gas storage
105*a-d* Compressed gas container
106, 106*a,b* Third valve arrangement and, respectively, valves of the third valve arrangement
107, 107*a,b* Enclosed area
108 Container valve
109, 109*a,b* Second valve arrangement and, respectively, valves of the second valve arrangement
110 First collecting line
111 Second collecting line
112 Backflow preventer
113 T or Y piece
114 Sensor unit
115 Temperature sensor
116 Pressure sensor
117 Oxygen sensor
118 Aspirating smoke detector
119 Alarm devices
120 User interface
121 Fire alarm control panel

What is claimed is:

1. An oxygen-reducing installation comprising:

compressed gas storage for storing an oxygen-reduced gas mixture or an inert gas in compressed form, the compressed gas storage comprising a plurality of compressed gas containers, each compressed gas container including a container valve, the compressed gas containers connected in parallel between a first collecting line and a second collecting line, and a fluid connection from the compressed gas storage to at least one enclosed area comprising a line system including the second collecting line and an area valve to feed at least a portion of the oxygen-reduced gas mixture or the inert gas to the at least one enclosed area, wherein each said compressed gas container is connectable at the container valve to an associated first line section in fluid communication with the first collecting line and to an associated second line section in fluid communication with the second collecting line;

at least one gas separation system for providing an oxygen-reduced gas mixture, and including an outlet for delivery of the oxygen-reduced gas mixture, the outlet connectable to an inlet to the compressed gas storage via an additional separate line system including the first collecting line and to the at least one enclosed area via a further separate line system to feed the oxygen-reduced gas mixture produced in the gas separation system to one or both of the compressed gas storage and the at least one enclosed area;

a compressor system on the additional separate line system between the outlet of the gas separation system and the inlet of the compressed gas storage to compress the oxygen-reduced gas mixture provided at the outlet of the gas separation system to be fed to the compressed gas storage, and a first valve on the additional separate line system between the compressor system and the compressed gas storage; and a common tee connector directly connected between the first line section and the second line section associated with each said compressed gas container, wherein the common tee connector is directly connected to two backflow preventers at opposite ends of the common tee connector and is directly connected to each said compressed gas container at another end.

2. The oxygen-reducing installation of claim 1, further comprising a compressor system upstream of the gas separation system for compression of an initial gas mixture to be fed to the gas separation system.

3. The oxygen-reducing installation of claim 1, further comprising a valve system comprising:

the first valve between the outlet of the gas separation system and the inlet of the compressed gas storage;

a second valve arrangement between an outlet of the compressed gas storage and the at least one enclosed area; and a third valve arrangement between the outlet of the gas separation system and the at least one enclosed area.

4. The oxygen-reducing installation of claim 3, wherein the inlet of the compressed gas storage and the outlet of the compressed gas storage comprise a common connector piece.

5. The oxygen-reducing installation of claim 3, further comprising a controller operative to actuate the first valve, the second valve arrangement, and the third valve arrangement of the valve system.

6. The oxygen-reducing installation of claim 5, wherein the controller is operative to actuate the valve system to connect the outlet of the gas separation system to the inlet of the compressed gas storage only when no flow connection is open between the outlet of the compressed gas storage and an inlet to the at least one enclosed area.

7. The oxygen-reducing installation of claim 5, wherein the controller is operative to actuate the valve system to connect the outlet of the gas separation system to the inlet of the compressed gas storage when a flow connection is open between the outlet of the compressed gas storage and an inlet to the at least one enclosed area.

8. The oxygen-reducing installation of claim 5, wherein the controller is operative to actuate the valve system to connect the outlet of the gas separation system to an inlet to the at least one enclosed area.

9. The oxygen-reducing installation of claim 5, wherein the gas separation system is operative in a first operational mode to introduce an oxygen-reduced gas mixture from the gas separation system to the compressed gas storage and in a second operational mode to introduce an oxygen-reduced gas mixture from the gas separation system to the at least one enclosed area.

10. The oxygen-reducing installation of claim 1, further comprising a controller operative to actuate the first valve, the container valves, and the area valve in a coordinated manner so that the outlet of the gas separation system is connectable for fluid communication with the inlet of at least one compressed gas container when the outlet of the at least one compressed gas container is in fluid communication with the at least one enclosed area.

11. The oxygen-reducing installation of claim 10, further comprising a pressure sensor disposed in at least one compressed gas container and in communication with the controller, and the controller is operative to open the first valve to connect the outlet of the gas separation system in fluid communication with the at least one compressed gas container when a sensed pressure reaches or falls below a predetermined minimum pressure.

12. The oxygen-reducing installation of claim 1, wherein the container valve of each of the compressed gas containers comprises a pneumatically actuatable quick release valve arrangement between the compressed gas container and the second collecting line, and the quick release valve arrangement is operable to switch off when the outlet of the gas separation system is connected for fluid communication with the compressed gas container.

13. The oxygen-reducing installation of claim 1, further comprising at least one backflow preventer of the two backflow preventers disposed between the container valve of at least one of the plurality of compressed gas containers and the second collecting line to block a gas flow from the second collecting line to the at least one of the plurality of compressed gas containers, or between the container valve of the at least one of the plurality of compressed gas containers and the first collecting line to block a gas flow from the second collecting line to the at least one of the plurality of compressed gas container, or between the container valve and both the second collecting line and the first collecting line.

14. The oxygen-reducing installation of claim 13, wherein the at least one backflow preventer comprises a non-return valve.

15. The oxygen-reducing installation of claim 1, wherein the at least one enclosed area includes a building or a room enterable by humans.

16. A method for operating an oxygen-reducing installation, comprising;

(a) providing the oxygen-reducing installation of claim 1;

(b) storing an oxygen-reduced gas mixture or an inert gas in compressed form in the compressed gas storage;

(c) for a reduction of an oxygen content in a spatial atmosphere of the at least one enclosed area, feeding at least a portion of the oxygen-reduced gas mixture or the inert gas in the compressed gas storage to the enclosed area;

(d) for maintaining a reduced oxygen content and/or for reducing the oxygen content in the spatial atmosphere of the at least one enclosed area, feeding an oxygen-reduced gas mixture from the gas separation system to the enclosed area; and (e) refilling the compressed gas storage at least partially with an oxygen-reducing gas mixture from the gas separation system.

17. The method of claim 16, wherein step (e) takes place after step (c).

18. The method of claim 16, wherein step (e) takes place in parallel with step (d).

* * * * *